United States Patent [19]

Jacobsen et al.

[11] Patent Number: 4,483,330

[45] Date of Patent: Nov. 20, 1984

[54] CONSTANT TENSION TRACTION DEVICE

[75] Inventors: Stephen C. Jacobsen; David F. Knutti, both of Salt Lake City; Richard D. Luntz, Murray, all of Utah

[73] Assignee: Motion Control, Inc., Salt Lake City, Utah

[21] Appl. No.: 400,914

[22] Filed: Jul. 22, 1982

[51] Int. Cl.[3] ..... A61H 1/02

[52] U.S. Cl. ..... 128/75; 269/128; 242/107.3

[58] Field of Search ..... 128/75, 84 C, 71; 272/131–133, 116, 125, 126, 137; 269/128, 287, 239; 242/107.3, 100.2; 188/65.1

[56] References Cited

U.S. PATENT DOCUMENTS

| | | | |
|---|---|---|---|
| 372,274 | 10/1887 | Oliver | 269/128 |
| 3,020,580 | 2/1962 | Glenn | 242/107.3 X |
| 3,042,339 | 7/1962 | Gschwind | 242/107.3 X |
| 3,085,768 | 4/1963 | Treutelaar | 128/75 |
| 3,117,572 | 1/1964 | Wright | 128/75 |
| 3,683,900 | 8/1972 | Alessi et al. | 128/75 |
| 3,710,787 | 1/1973 | Rabjohn | 128/75 |
| 4,074,897 | 2/1978 | Behn | 269/128 X |
| 4,266,537 | 5/1981 | Bonin, Jr. et al. | 128/75 |
| 4,328,965 | 5/1982 | Hatfield | 272/137 |

*Primary Examiner*—Richard J. Apley
*Assistant Examiner*—Chris Coppens
*Attorney, Agent, or Firm*—Thorpe, North & Western

[57] ABSTRACT

A compact traction device includes a housing and a plurality of constant tension spring units disposed within the housing. Each constant tension spring unit includes a cable which extends from the unit through an opening in the housing. As the cable is pulled out from the housing, a substantially constant tension is developed on the cable. Hook elements are coupled to the end of each cable to enable attaching the cable to a ring or other connecting structure which, in turn, would be attached to some part of the body of a person utilizing the traction device. A brake device is included in the housing for each constant tension spring unit to inhibit the rapid retraction into the housing of the cables when the cables are released. A clamp is mounted on the exterior of the housing to enable attaching the traction device to a support frame. The clamp allows positioning of the device to have almost any orientation.

10 Claims, 8 Drawing Figures

4
70
72
74
8c
12
254
18
46
2
4
8
8
16
20d
250
32
28
20a
44
20c
24
20b
36
40
58
90
88
94
104
112
108
54
76
64
100
102
68
101
84
86
111
89
110

CONSTANT TENSION TRACTION DEVICE

BACKGROUND OF THE INVENTION

This invention relates to a compact constant tension traction device capable of developing a plurality of different tension forces, as selected by a user.

Conventional orthopedic traction apparatus used for applying tension forces to parts of the body of a patient typically includes a rather complicated and cumbersome combination of a framework, pulleys, ropes, and weights. The framework is erected over the hospital bed and conventional pulleys are attached to the framework and ropes are threaded through the pulleys. One end of each rope is attached to a part of the patient's body and the other end is attached to a weight which hangs vertically downward from the pulley. The weights may either be heavy metal discs, liquid-filled bags, or sand-filled bags. Not only is such apparatus cumbersome, but also it is unsightly, difficult and time consuming to assemble and disassemble, and difficult to store because of the bulkiness. In addition it is difficult to either move a patient about or for the patient to move himself while undergoing traction with such apparatus.

There have been proposed a number of arrangements which would obviate the need for the combination of pulleys, ropes and weights. Some of such arrangements are disclosed in U.S. Pat. Nos. 3,060,929, 3,085,768, 3,153,411 and 3,683,900. These references all disclose devices which utilize constant tension spring elements for producing tension forces for holding in place limbs or other parts of the body of a patient. Although the devices disclosed are more compact and apparently more convenient for use than the pulley, rope and weight arrangements, one problem which is common to these devices is the rapid, "snap back" retraction of tension cables which would result if the cables are inadvertently released. For example, if a tension cable slipped loose from its support position, it might be rapidly drawn toward the device housing and possibly cause an injury to persons or damage to the device.

SUMMARY OF THE INVENTION

It is an object of the invention to provide a simple, lightweight and compact constant tension traction device by which a plurality of different and selectable tension forces may be developed.

It is another object of the invention to provide a constant tension traction device which includes brake apparatus for preventing rapid retraction of tension cables when the cables are released.

It is a further object of the present invention to provide such a device having convenient and easy to use cable connection structure for coupling the tension cables to the elements used for supporting the patient's limbs or other body parts.

It is also an object of the invention, in accordance with one aspect thereof, to provide a constant tension traction device which is mountable on support structure to have substantially any orientation.

These and other objects of the present invention are realized in one specific illustrative embodiment thereof which includes a housing and at least one constant tension spring unit mounted in the housing. The spring unit includes a movable cable upon which the member develops a substantially constant tension force. A brake member is also disposed in the housing to inhibit rapid retraction of the cable after the cable has been pulled outwardly from the housing and then released.

A plurality of such constant tension spring units may be included in the housing and adapted so that each such member produces a tension force different from the other members. Then, different combinations of the constant tension spring units can be utilized to produce a variety of different tension forces for application to the limbs or other body parts of a patient.

A clamp is mounted on the exterior of the housing to enable attaching the housing to a support structure so that the housing, and in particular the constant tension spring units, can be "aimed" in almost any direction.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figures 1, 3:
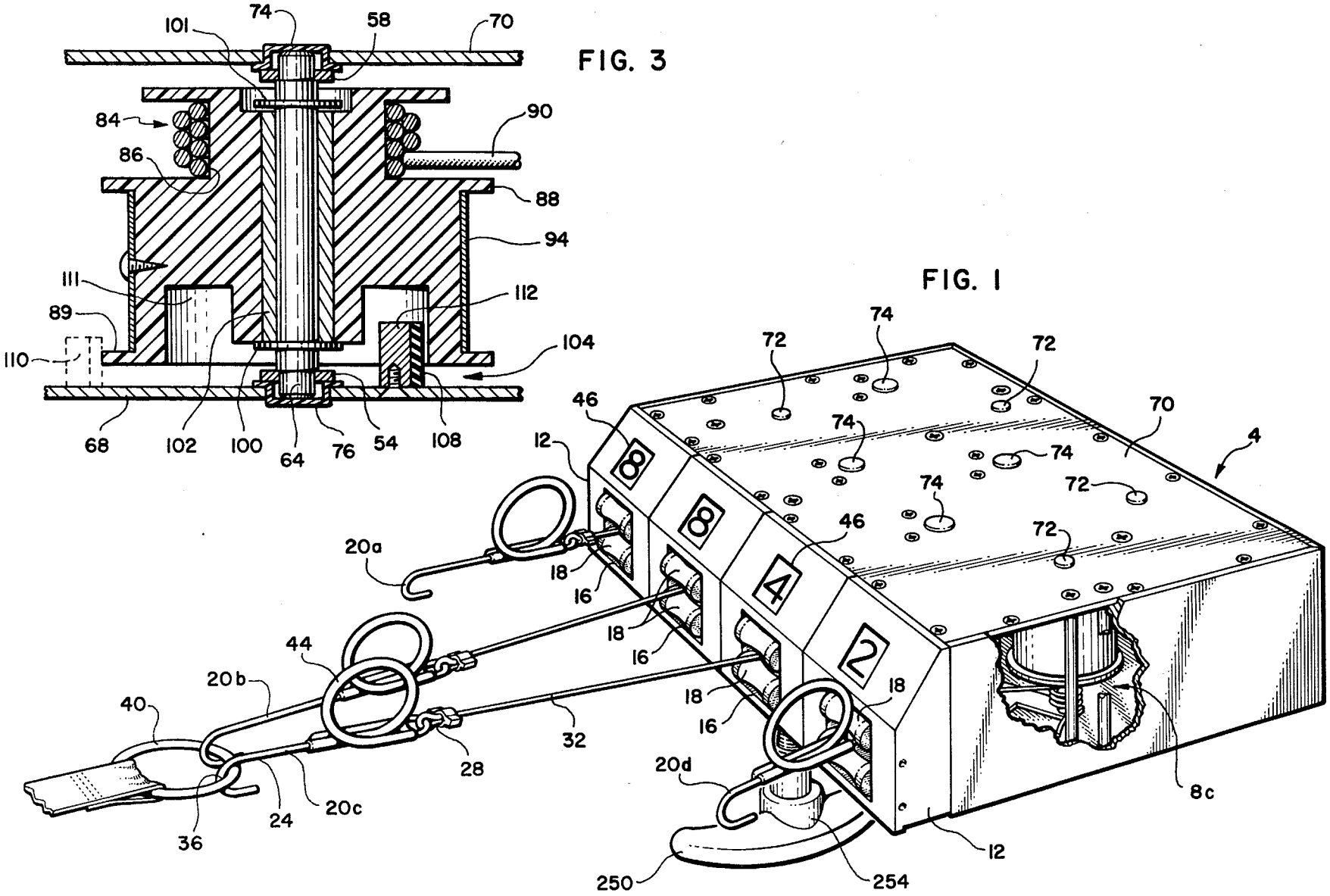
FIG. 1 is a perspective, partially cut away view of a traction device made in accordance with the principles of the present invention.
FIG. 3 is a side cross-sectional view of the spool 84 and brake mechanism of the spring unit of FIG. 2.

Referring to FIG. 1, there is shown a specific illustrative embodiment of the present invention which includes a housing 4 in which are disposed four constant tension spring units such as unit 8*d*. The units are arranged in the housing 4 in a compact configuration such as that diagrammed in FIG. 5 (to be discussed later) to enable extension of a cable forwardly from each unit to a front wall 12 of the housing. The manner of connecting the cables to the constant tension spring units and the operation of such units will be discussed later.

A cable from each of the constant tension spring units extends forwardly through a different opening 16 formed in the front wall 12 of the housing. Positioned in each opening and rotatably mounted in the housing 12 is a pair of parallel rollers 18 between which a corresponding cable extends. Positioned behind each pair of such rollers is another pair of parallel rotatable rollers (shown in FIG. 5) oriented at a 90° rotation from the orientation of rollers 18. A corresponding cable extends between the rollers of each pair to enable a user to readily pull the cable away from the housing 12 at various angles without having the cable bind or rub against any nonrotatable part.

Coupled to each of the cables is a different one of a plurality of connecting elements 20*a* through 20*d*. Each of the connecting elements includes an elongate shank 24 (refer to element 20*c*), one end of which is formed into an eyelet 28 to which a cord or cable 32 is connected. The other end of the shank 24 is formed into a hook 36 suitable for coupling or "hooking" onto a ring 40 or similar structure which, in turn, would be connected to a sling, support, etc., for supporting a part of the body of a person to whom the traction forces were to be applied. For this purpose, the hook 36 curves downwardly and then rearwardly in a typical hook-like fashion. The shank 24 is curved to form a gripping loop 44 near the eyelet 28. The loop 44 projects from the shank 24 to enable inserting a finger into the loop opening. The loop 44 facilitates pulling the corresponding cable outwardly from the housing 4 to the ring 40 or similar connecting apparatus.

As can be seen in FIG. 1, the lengths of the shanks of the connecting elements vary. Thus, the length of the shank of connecting element 20*a* is the shortest whereas the length of the shank of connecting element 20*d* is greatest. This feature facilitates coupling the connecting elements to and unconnecting the elements from the ring 40 since, when the connecting elements are coupled to the ring 40, the loops are staggered so that one loop will not interfere with the seizure or grasping of another loop. Connecting elements 20*b* and 20*c* are shown coupled to the ring 40 in FIG. 1 and it is clear that the loops of these connecting elements are not side by side so that a person could more readily slip his finger into either loop without interference from the other.

Indicia 46 are affixed on the housing 4 above corresponding openings 16 to identify the tension force produced by the constant tension spring units 8. Thus, the constant tension spring unit to which element 20*a* is connected produces a tension force of 2 lbs., whereas the unit to which element 20*b* is connected produces a tension force of 4 lbs., etc.

Figure 2:
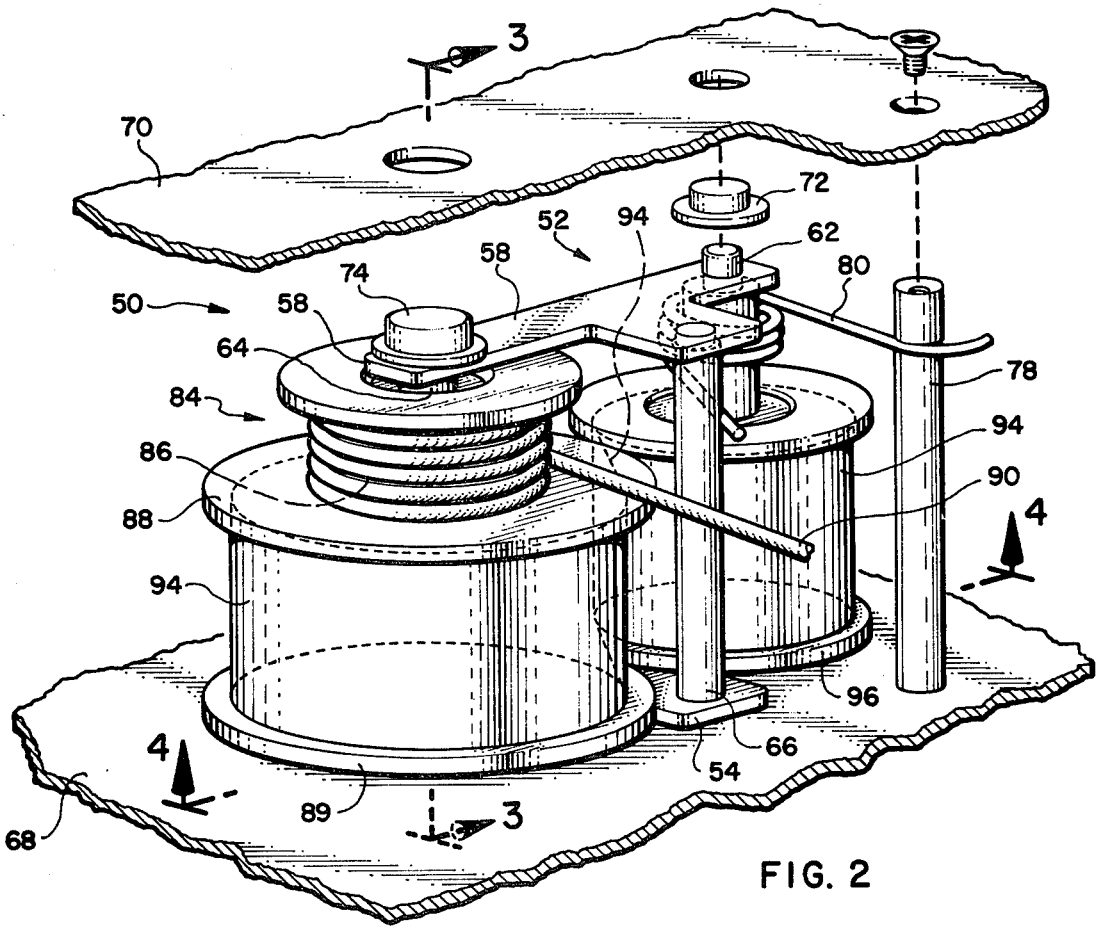
FIG. 2 is a perspective view of one constant tension spring unit made in accordance with the present invention.
Figure 4:
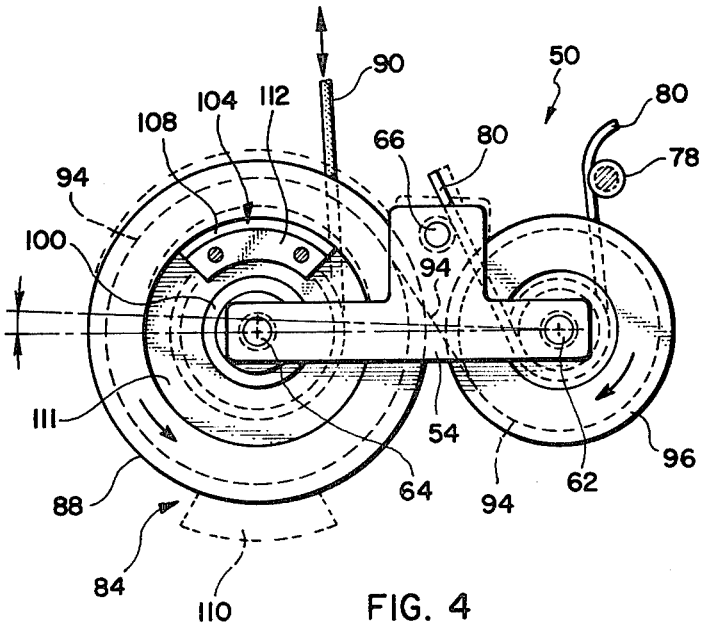
FIG. 4 is a top plan view of the constant tension spring unit of FIG. 2, with the top plate omitted.

FIGS. 2 through 4 show different views of a constant tension spring unit 50 made in accordance with the present invention and suitable for use in the traction device of FIG. 1. The constant tension spring unit includes a pair of spaced apart generally parallel pivot plates 54 and 58. Extending between these plates are two mounting axles 62 and 64 and a bracing rod 66. The mounting axles 62 and 64 extend through openings in the plates 54 and 58 and are rigidly secured in these openings by welding, press fitting, etc. Rod 66 is similarly secured to pivot plates 54 and 58. The plates 54 and 58, axles 62 and 64 and rod 66 provide a substantially rigid frame 52 on which other elements of the constant tension spring unit may be mounted.

The constant tension spring unit 50 is mounted between a pair of mounting plates 68 and 70 which might illustratively be the bottom and top walls of the housing 4 of FIG. 1 or some other suitable framework. In particular, caps 72, 74 and 76 (FIGS. 2 and 3) are securely fitted in openings in the mounting plates 68 and 70 and then the axles 62 and 64 are positioned in the caps. (A fourth cap, which is not shown, is fitted in mounting plate 68 and over the lower end of axle 62.) The axle 62 is rotatably fitted in cap 72 and the other cap not shown, while the axle 64 is positioned in caps 74 and 76 (FIG. 3) so that it can move therewithin. With this configuration, pivot plates 54 and 58 are arranged to pivot about axle 62, for purposes to be described momentarily.

A pin 78 extends between mounting plates 68 and 70 at a location near the axle 62. A torsion spring 80 is wrapped about the axle 62, with the free ends of the spring extending between bracing rod 66 and pin 78 and being forced thereagainst. In this position, the spring 80 functions to bias the pivot plates 54 and 58 away from the pin 78 (rearwardly in FIG. 2).

A spool 84 is rotatably mounted on axle 64. The spool 84 has two reel portions 86 and 88. The reel portion 86 is shown to be smaller in diameter than the reel portion 88 but this is not a requirement for the device and the two reel portions could be the same size. Wound on the reel portion 86 is a cable 90 to which is attached a connecting element (not shown in FIGS. 2 and 3) similar to those shown in FIG. 1. Attached to the reel portion 88 is one end of a prestressed strip spring 94. The strip spring 94 is normally wound upon and carried by a second spool 96 which is rotatably mounted on axle 62.

The strip spring 94 is attached to the reel portion 88 of spool 84 so that when the cable 90 is pulled outwardly from the constant tension spring unit 50, the spring 94 is caused to wrap around and be transferred to the reel portion 88. As this transfer takes place, the strip spring is stressed in a direction which is the reverse of the direction of stress of the spring when it is wound upon spool 96. As a result, the strip spring 94 generates a return driving force to tend to cause the spring to reel itself back onto spool 96. This return driving force is substantially constant regardless of the amount of the strip spring 94 which is reversely wound upon reel portion 88 of spool 84. This type of action is well known and is fully described in U.S. Pat. No. 3,060,929.

As indicated earlier, the axle 64 is arranged to move within the caps 74 and 76 (FIG. 3). In other words, the inside diameters of the caps are greater than the outside diameter of the axle 64. This enables the axle 64 to move either in the direction in which the cable 90 is pulled or in the opposite direction. Also shown in FIG. 3 are two clip washers 100 and 101 mounted about axle 64 to confine up and down movement of the spool 84 on the axle 64. A bearing 102 surrounds the axle 64 between the axle and spool 84. Similar clip washers are provided for the axle 62 and spool 96 (FIG. 2).

Mounted on the bottom mounting plate 68 is a brake element 104 which includes a pad 108 attached to a shoe member 112. The brake element 104 is mounted to extend upwardly from the plate 68 to within a hollow 111 formed in the bottom of reel portion 88 of the spool 84. The pad 108 is positioned adjacent an interior wall of the hollow 111 to engage the wall when the spool 84 is moved a certain distance in the direction opposite the direction in which the cable 90 is pulled. Of course, the brake element 104 could be positioned at any location where contact could be had with the spool 84 when the spool were moved in the direction indicated. Such a location could be adjacent a lower annular guide 89 of the spool 84 and behind the spool, as shown by dotted line 110 in FIG. 3.

When the constant tension spring unit 50 is not being utilized, i.e., when it is in what might be called a "rest position", the torsion spring 80 biases the frame 52 and thus the spool 84 backwardly (to the left in FIG. 3) so that the interior wall of the hollow 111 of spool 84 contacts the pad 108 of the brake element. In this position, the axle 64 on which the spool 84 is mounted is positioned close to but not in contact with the rear inside surfaces of the caps 74 and 76. When the cable 90 is pulled forwardly of the constant tension spring unit 50 (to the right in FIG. 3), the spool 84 and thus the frame 52 are caused to pivot forwardly. The tension forces of the torsion spring 80 and strip spring 94 are selected so that the spring 94 will prevent rotation of the spool 84 until the spool 84 has been moved away from and out of contact with the brake element 104. As the spool 84 is moved away from the brake element 104, the axle 64 is caused to move from near the rear inside surfaces of the caps 74 and 76 forwardly to contact the forward inside surfaces of the caps. In other words, as the cable 90 is pulled forwardly to cause the spool 84 to move forwardly, the axle 64, being mounted to extend between pivot plates 54 and 58, is also caused to move. The inside diameter of the caps 74 and 76, however, limits the excursion of movement of the axle 64 and so when the spool 84 has moved forwardly to the point where the axle 64 contacts the forward portion of the inside of the caps 74 and 78 (to what might be referred to as the "operate position"), application of additional force on the cable 90 causes the reel portion 86 and thus the reel portion 88 to rotate and this, in turn, causes the strip spring 94 to unwind from the spool 96 and to wind upon the reel portion 88. The cable 90 would be pulled forwardly to some point where the cable's connecting element would be "hooked" to ring or similar coupling apparatus (such as shown in FIG. 1). In this position, the constant tension spring unit 50 would exert a substantially constant tension force on the cable 90.

When the connecting element were unhooked from its coupling apparatus, as long as some force above a certain threshold were maintained on the cable 90, the spool 84 would be caused to reel in the cable under the tension of the strip spring 94. If the cable 90 were suddenly released or if the force on the cable 90 were to fall below the certain threshold, then the torsion spring 80 would cause the pivot plates 54 and 58 and thus the spool 84 to move rearwardly until the wall of the hollow 110 of spool 84 contacted the brake element 104 to prevent the spool 84 from rotating or to slow rotation of the spool, depending upon the spring tension forces selected for the constant spring unit. The effect of this would be to prevent a rapid rewinding of the cable 90 in case of an inadvertent release of the cable. As long as a force above the threshold level is maintained on the cable, the spool 84 is not allowed to contact the brake element 104 so that the spool will be allowed to rewind. In this manner, a safe and yet compact constant tension spring unit is provided for use in a traction device as shown and described in FIG. 1.

Selection of appropriate tension forces for the torsion spring 80 and strip spring 94 involves straightforward moment arm and moment of force calculations.

Figure 5:
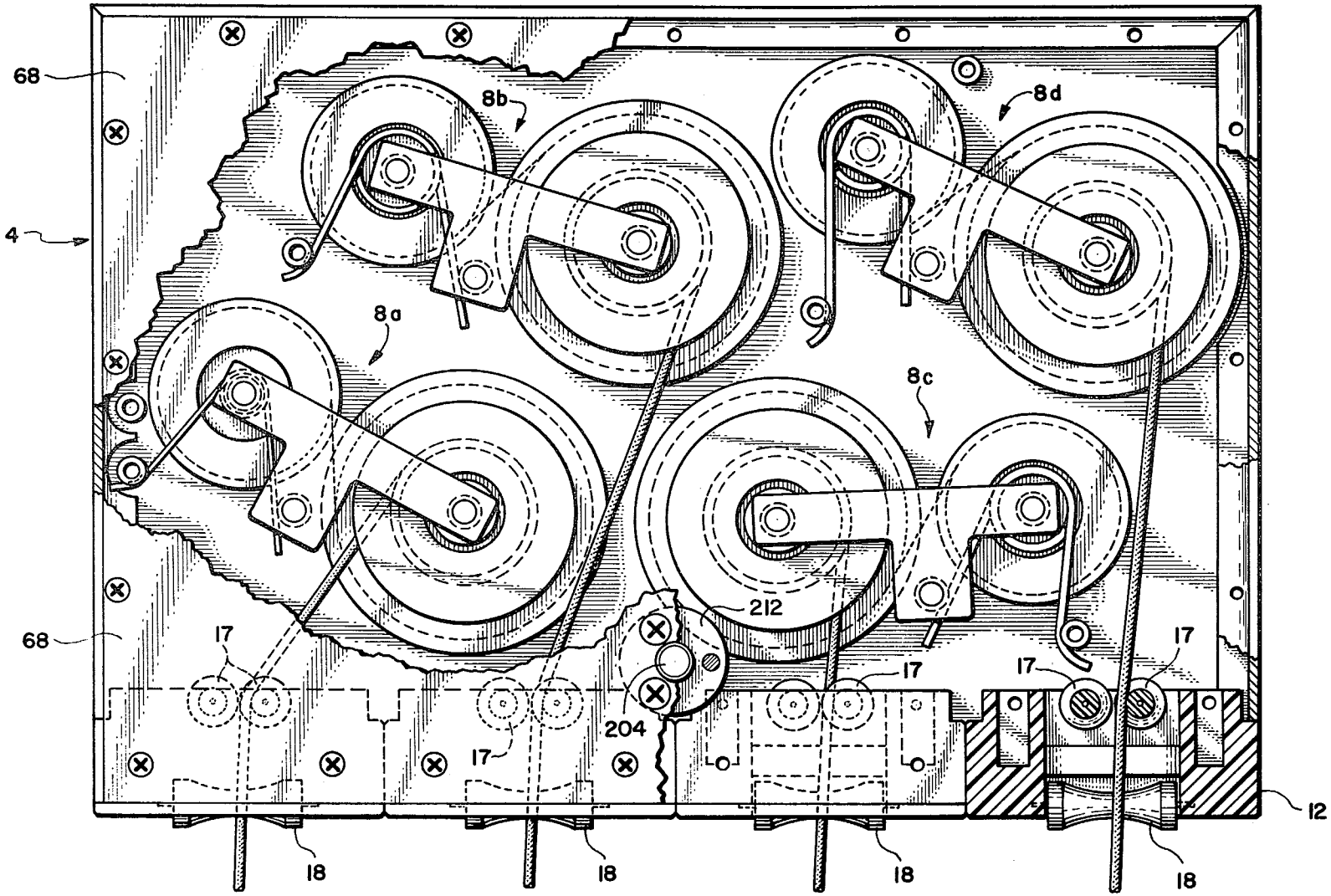
FIG. 5 is a diagrammatic top plan view of four constant tension spring units arranged in a housing.

FIG. 5 is a top plan view graphically showing an illustrative arrangement of four constant tension spring units 8*a*, 8*b*, 8*c* and 8*d* disposed in the housing of FIG. 1. Each of these units, of course, includes a pair of spools rotatingly joined by a strip spring, a torsion spring for biasing the unit generally rearwardly against a corresponding brake element, and a cable coupled to one of the spools and threaded through a corresponding pair of rollers 17 and then through another corresponding pair of rollers 18 to exit from the housing, as already described. Although a particular arrangement of constant tension spring units is shown in FIG. 5, it is apparent that a variety of other arrangements could also be provided to achieve a compact configuration, with the primary requirement being that no constant tension spring unit interferes with any other such unit.

Figure 6A:
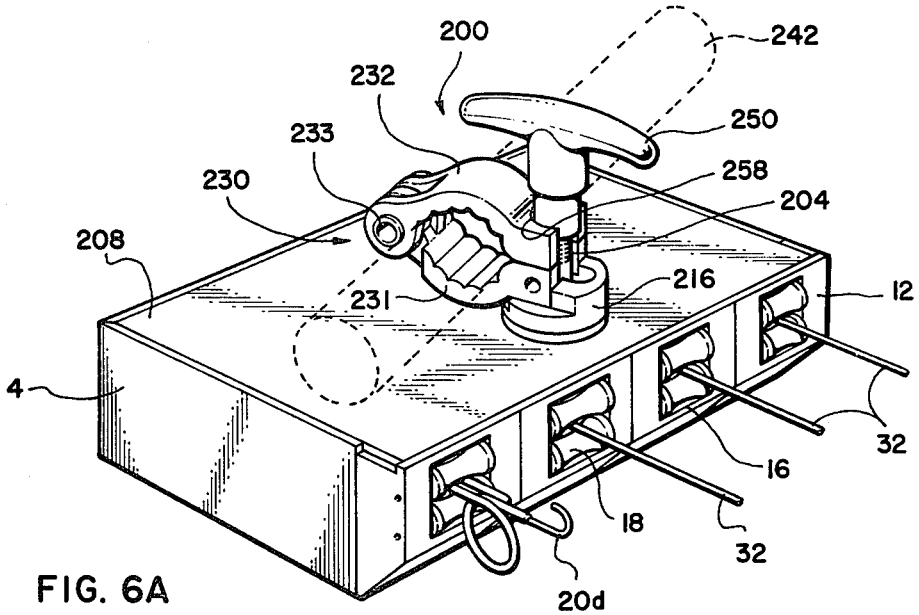
FIG. 6A is a perspective view of the traction device, showing clamping apparatus mounted thereon.
Figure 6B:
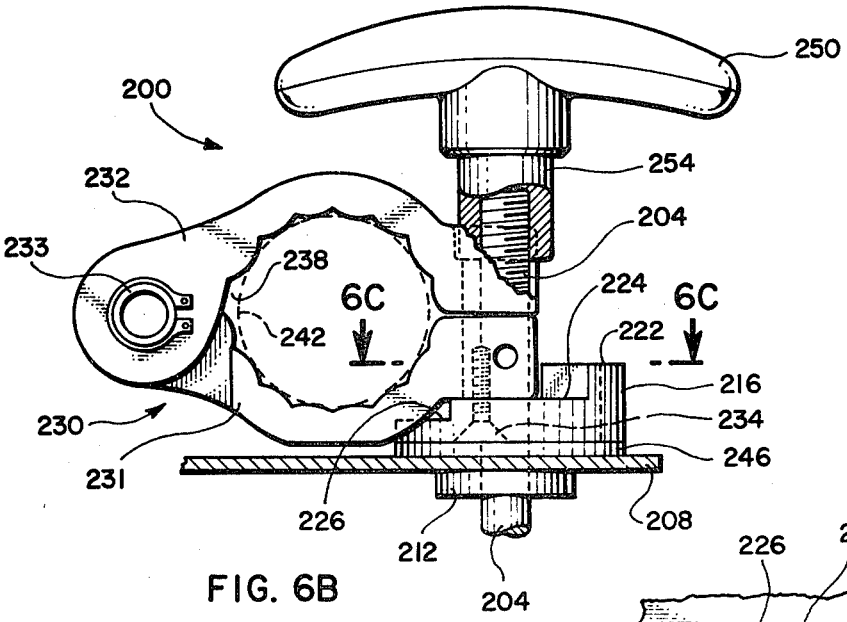
FIGS. 6B and 6C are respectively a side, elevational view of the clamping apparatus, and a top plan view of a portion of the clamping apparatus.
Figure 6C:
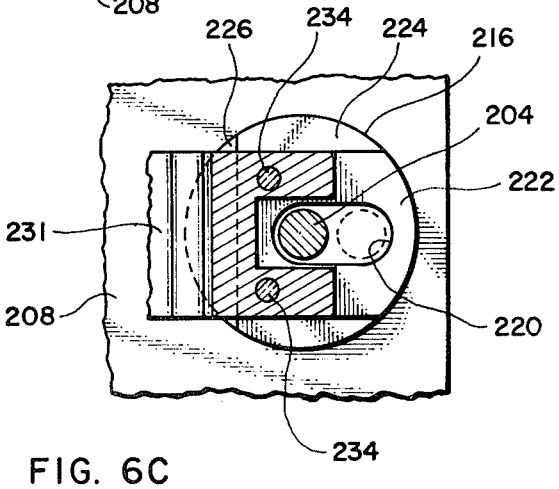

FIGS. 6A through 6C show a clamping mechanism 200 mounted on the underneath side of the housing 4 of the constant tension traction device. The clamping mechanism shown is similar to the so-called Zimmer clamp, but includes features not found in the Zimmer clamp which enhance the versatility of the mechanism.

The clamping mechanism 200 includes a central post 204 which extends through the underneath or bottom wall 208 of the housing 4. A plate 212 is rigidly secured to the post 204 and to the interior surface of the bottom wall 208 to thereby support and maintain the post 204 in a generally perpendicular orientation with respect to the bottom wall. Advantageously, the post 204 extends through the housing 4 and is anchored to the top wall of the housing to provide a more rigid support for the post.

The clamping mechanism 200 further includes a generally circular clamp mounting base 216 having an oblong slot 220 formed therein. The base 216 is positioned about the post 204 so that the post extends through the slot. With this configuration, the base 216 is slidable along the length of the slot 220 as well as being rotatable about the post 204. The base 216 is formed with three landings 222, 224 and 226 which are generally parallel but at different elevations from one another.

Mounted on the base 216, and in particular on the landing 224, is a two piece clamp 230. Screws (one of which is shown by dotted line 234 in FIG. 6B) are used to mount one end of a generally arcuate shaped lower jaw 231 of the clamp 230 onto the base 216. An arcuate shaped upper jaw 232 of the clamp is pivotally attached by a pin 233 to the lower jaw 231 to enable pivoting the upper jaw upwardly and away from the base 216 and post 204. When the upper and lower jaws of the clamp 230 are closed, as shown in the drawings, so that the nonjoined ends of the jaws are mated, an opening 238 is formed between the jaws to accommodate and receive a beam or bar 242 on which the traction device is to be mounted. The facing surfaces of the jaws 231 and 232 are serrated to enhance the gripping ability of the clamp 230.

A pad 246 is attached to the bottom of the base 216 by glue or other adhesive to provide a cushion between the base 216 and the bottom wall 208 of the housing 204 and to facilitate movement of the base relative to the bottom wall.

The upper end of the post 204 is threaded to receive a handle 250 which has a threaded, cylindrically-shaped opening for screwing onto the post. When the handle 250 is screwed tightly onto the post 204, a lower abutment 254 of the handle contacts the upper surface of a recess 258 formed in the upper jaw 232 to maintain the clamp 230 in a closed position and to maintain the entire clamping mechanism 200 in a fixed position against the underneath side of the housing 4. In such a position, the clamping mechanism 200 cannot be rotated or otherwise moved. When the handle 250 is unscrewed, it is caused to move away from the upper jaw 232 of the clamp to thereby release the clamp. The clamp 230 and clamp base 212 may then be rotated about the post 204 or moved along the length of the slot 220. The slot 220 facilitates movement of the clamp 230 away from the post 204 so that the upper jaw 232 of the clamp may be more readily pivoted upwardly and away from the lower jaw 231 without inhibition from the handle 250.

In use, the clamp 230 would be placed about a support bar 242 on which the traction device was to be mounted, and then slid on and rotated about the bar to the desired position. The housing 4 would then be rotated to cause rotation of the post 204 within the slot 220, until the housing was facing or pointed in the desired direction—toward the limb of the person to which the traction device was to be attached. The clamping mechanism 200 allows positioning the housing 4 to face in almost any direction.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A constant tension traction device comprising a framework, a frame member movably mounted in said framework to move between first and second positions, means for biasing said frame member toward said first position, a spool rotatably mounted on said frame member, a spring element coupled to said spool for providing a substantially constant tension on the spool as the spool is rotated in a first direction, and for tending to cause the spool to rotate in a second direction, opposite said first direction, after the spool has been rotated in the first direction, cable means wound about said spool so that as the cable means is pulled outwardly in a certain direction from the framework, the frame member is moved to the second position and the spool is rotated in said first direction, and brake means mounted on said framework for contacting and inhibiting rotation of said spool when the frame member is in the first position, said brake means thereby preventing rapid rotation of the spool in the second direction when the cable means is released.

2. A traction device as in claim 1 wherein said frame member includes a pair of spaced apart, generally parallel plates pivotally mounted at one end to said framework to pivot between the first and second positions, and wherein said spool is rotatably mounted between said plates at a location spaced from the pivot axis of the plates.

3. A traction device as in claim 2 wherein said biasing means includes a spring means positioned in contact with said plates and with said framework for urging said plates toward the first position.

4. A traction device as in claim 3 wherein said spool includes first and second coaxially disposed reel portions which are joined to rotate together, said cable means being wound about said first reel portion, and wherein said spring element includes a second spool rotatably mounted between said plates and spaced from the first-mentioned spool, and a strip spring wound upon and carried by said second spool and having a free end which is attached to said second reel portion and upon which the spring is adapted to be wound when the first-mentioned spool is caused to be rotated in the first direction.

5. A traction device as in claim 4 wherein said first mentioned spool is formed with a hollow at one end thereof, and wherein said brake means is mounted on said framework to project into the hollow of the first mentioned spool to contact an interior wall of the hollow and thereby inhibit rotation of the spool when the frame member is in the first position.

6. A selectable tension traction device comprising a housing having a plurality of openings in one side thereof, a plurality of constant tension spring means disposed in said housing, each including a movable cable means upon which a substantially constant tension force is developed as the cable means is moved outwardly from the corresponding constant tension spring means, a free end of each of said cable means extending through a different one of the openings in said housing, and a plurality of connecting elements, each coupled to the free end of a different one of said cable means and each including a generally elongate shank, one end of which is coupled to the free end of a corresponding cable means and the other end of which is formed into a hook, and a gripping portion formed to project from the shank, and wherein the length of each shank of said connecting elements is different from the length of any other shank.

7. A traction device as in claim 6 further including a plurality of brake means mounted in said housing, each for inhibiting the rapid retraction into the housing of a corresponding cable means.

8. A traction device as in claim 6 wherein the hook of each shank is formed to extend from one side of the shank, and wherein each gripping portion projects from the opposite side of a corresponding shank.

9. A traction device as in claim 6 wherein each gripping portion is formed with an opening therein suitable for inserting a finger thereinto.

10. A constant tension traction device comprising a housing having a plurality of openings in one side thereof, a plurality of constant tension spring means disposed in said housing, each including a movable cable means upon which a substantially constant tension force is developed as the cable means is moved outwardly from the corresponding constant tension spring means, a free end of each of said cable means extending through a different one of the openings in said housing, a plurality of connecting elements, each coupled to the free end of a different one of said cable means, and clamping means attached to a side of said housing other than said one side, said clamping means including a post affixed in a wall of said housing to extend outwardly thereof, said post being threaded on its outer end, a mounting base member having a generally oblong slot therein to enable placement of the base member over said post so that the post extends through said slot, said base member being rotatable about said post and movable along the length of said slot, a clamp having a first, generally arcuate jaw mounted on said base member, and a second, generally arcuate jaw mounted on said first jaw to move between an open position and a closed position, and handle means screwable onto said post to contact said second jaw and maintain it in the closed position, and to force said base member against said wall of said housing to maintain the base member and clamp in a rigid position relative to said housing.

* * * * *